US005433094A

United States Patent [19]

Sandin et al.

[11] Patent Number: 5,433,094

[45] Date of Patent: Jul. 18, 1995

[54] LOCKING DEVICE FOR OUTBOARD MOTORS

[75] Inventors: Johan Sandin; Sven Johansson, both of Saltsjöbaden, both of Sweden

[73] Assignee: Marine Protect In Scandinavia AB, Saltsjobaden, Sweden

[21] Appl. No.: 127,077

[22] Filed: Aug. 27, 1993

[63] Continuation-in-part of PCT/SE92/00198, Mar. 30, 1992.

[30] Foreign Application Priority Data

Mar. 28, 1991 [SE] Sweden ..... 9100937

[51] Int. Cl.[6] ..... E05B 73/00

[52] U.S. Cl. ..... 70/58; 70/232

[58] Field of Search ..... 70/14, 57, 58, DIG. 57, 70/229–232, 258, 164; 248/553, 643

[56] References Cited

U.S. PATENT DOCUMENTS

| | | | |
|---|---|---|---|
| 1,579,736 | 4/1926 | Stone . | |
| 3,514,172 | 5/1970 | Buchman | 70/58 X |
| 3,526,110 | 9/1970 | Foote | 70/58 X |
| 3,564,879 | 2/1971 | Bennett . | |
| 3,600,914 | 8/1971 | Johnson | 70/232 X |
| 3,798,938 | 3/1974 | McCullum | 70/417 |
| 3,889,500 | 6/1975 | Hix et al. | 70/232 |
| 4,030,324 | 6/1977 | Rizio | 70/212 X |
| 4,228,983 | 10/1980 | Bowman, Jr. | 70/58 X |
| 4,522,048 | 6/1985 | Davis | 70/417 |
| 4,557,458 | 12/1985 | Vahlberg et al. | 248/553 |
| 4,724,689 | 2/1988 | Anchia | 70/58 |
| 4,756,175 | 7/1988 | Matsushima et al. | 70/57 X |
| 4,777,809 | 10/1988 | Wiggins | 70/58 X |
| 4,893,487 | 1/1990 | Johnson | 70/211 X |
| 5,022,534 | 6/1991 | Briggs | 70/58 X |
| 5,102,357 | 4/1992 | Bruesch et al. | 248/643 X |

FOREIGN PATENT DOCUMENTS

| | | | |
|---|---|---|---|
| 883305 | 7/1943 | France | 70/58 |
| 1447335 | 6/1966 | France | 70/57 |
| 800104 | 9/1950 | Germany | 70/232 |
| 437537 | 3/1985 | Sweden . | |
| 226145 | 6/1943 | Switzerland | 70/58 |
| 1532282 | 11/1978 | United Kingdom | 70/232 |

OTHER PUBLICATIONS

McGard advertisement entitled "Protection That Your Customers Need, Profits that You Expect", 1993.

*Primary Examiner*—Lloyd A. Gall

*Attorney, Agent, or Firm*—Roylance, Abrams, Berdo & Goodman

[57] ABSTRACT

A locking device for outboard motors has a lock case with a lockable and releasable lock, a bolt casing fixedly attached to the lock case and a clamping bolt in threaded engagement with a hole in the stern bracket of the motor to attach the motor to the stern of a boat. When the locking device is mounted, the head of the clamping bolt is completely enclosed by the lock case and lock. The other end of the bolt engages the stern. The bolt intermediate portion is protected by the bolt casing against manipulation from outside.

13 Claims, 4 Drawing Sheets

LOCKING DEVICE FOR OUTBOARD MOTORS

CROSS-REFERENCE TO RELATED APPLICATION

This application is a continuation-in-part of PCT/SE92/00198, filed Mar. 30, 1992.

FIELD OF THE INVENTION

The present invention relates to a locking device for outboard motors.

Description of the Prior Art

An enormous number of outboard motors are being stolen all over the world despite marine motor locks which are available on the market and approved by the insurance companies.

Although existing locks are approved in the trade, an outboard motor can be stolen in but a few minutes. Frequent modes of attack even if the motor is "locked" are, for example, to remove the motor from the stern by wiggling it, to saw off the lock construction at a convenient point of access, or to heat part of the lock by means of a simple LPG miniburner in order to melt plastic elements of the lock, thereby making the approved locks fall apart. A further mode of attack is to demolish or break away the lock cylinder.

Swedish published application 437,537 discloses an anti-theft device for outboard motors, comprising a partly slitted tube to receive the heads of two attaching bolts of the motor which thread into the stern brackets. One end of the tube is adapted to be sealed by means of an end plug fitted with a cylinder lock. This anti-theft device necessitates a long tube since this must cover the two bolt heads by a margin, and an outer lock sleeve accommodating a cylinder lock whose end surface is aligned with that of the slitted tube. This prior art construction involves a risk of manipulation of the cylinder lock, the lock sleeve and/or the slitted tube, and also of the bolt head adjacent the open end of the tube. Moreover, a saw blade or the like may be applied to the attaching bolts on the one hand between the slitted tube and the stern brackets of the motor and, on the other hand, between the stern brackets and the stern of the boat.

OBJECTS OF THE INVENTION

One object of the present invention is to provide a boat locking device which prevents the clamping bolt in its entirety from being tampered with.

A further object of the invention is to provide a boat locking device which separately protects one or more clamping bolts, comprises a minimum number of components and is difficult to force open.

SUMMARY OF THE INVENTION

According to the invention, these objects are achieved by a locking device for an outboard motor comprising a bolt casing, a clamping bolt with an abutment portion, a tubular lock case and a lock means. The bolt casing has opposed openings therein and means for engaging an outboard motor mount. The clamping bolt has a thread means for engaging an outboard motor stern bracket, a bolt head at one end thereof and an integral cylindrical extension pin means extending from an opposite end thereof for engaging the outboard motor mount, and extends through the openings in the bolt casing. The thread means is enclosed in the bolt casing. The bolt head and the extension pin means extend from opposite ends of the bolt casing. The abutment portion on the clamping bolt is between the extension pin means and the thread means, and engages a respective one of the openings in the bolt casing and presses the bolt casing against the motor mount. The tubular lock case is fixedly attached to the bolt casing, encloses the bolt head, and has an internal cooperating part and a lock case opening. The lock means is removably mounted in the lock case through the lock case opening and is releasably engagable with the cooperating part to control access to the bolt head through the lock case. An end of the lock means remote from the bolt head is positioned inwardly of the lock case opening.

Briefly, the features of a presently preferred embodiment thus comprise a pin inside the stern, which cannot be removed owing to the construction of the lock case, the alternative positioning of the lock means, and the fact that the locking shoulder is designed to eliminate the susceptibility of the lock means to attack.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Preferred embodiments of the invention will now be described in more detail for the purpose of exemplification and with reference to the accompanying drawings in which.

DESCRIPTION OF THE PREFERRED EMBODIMENTS

Figure 1:
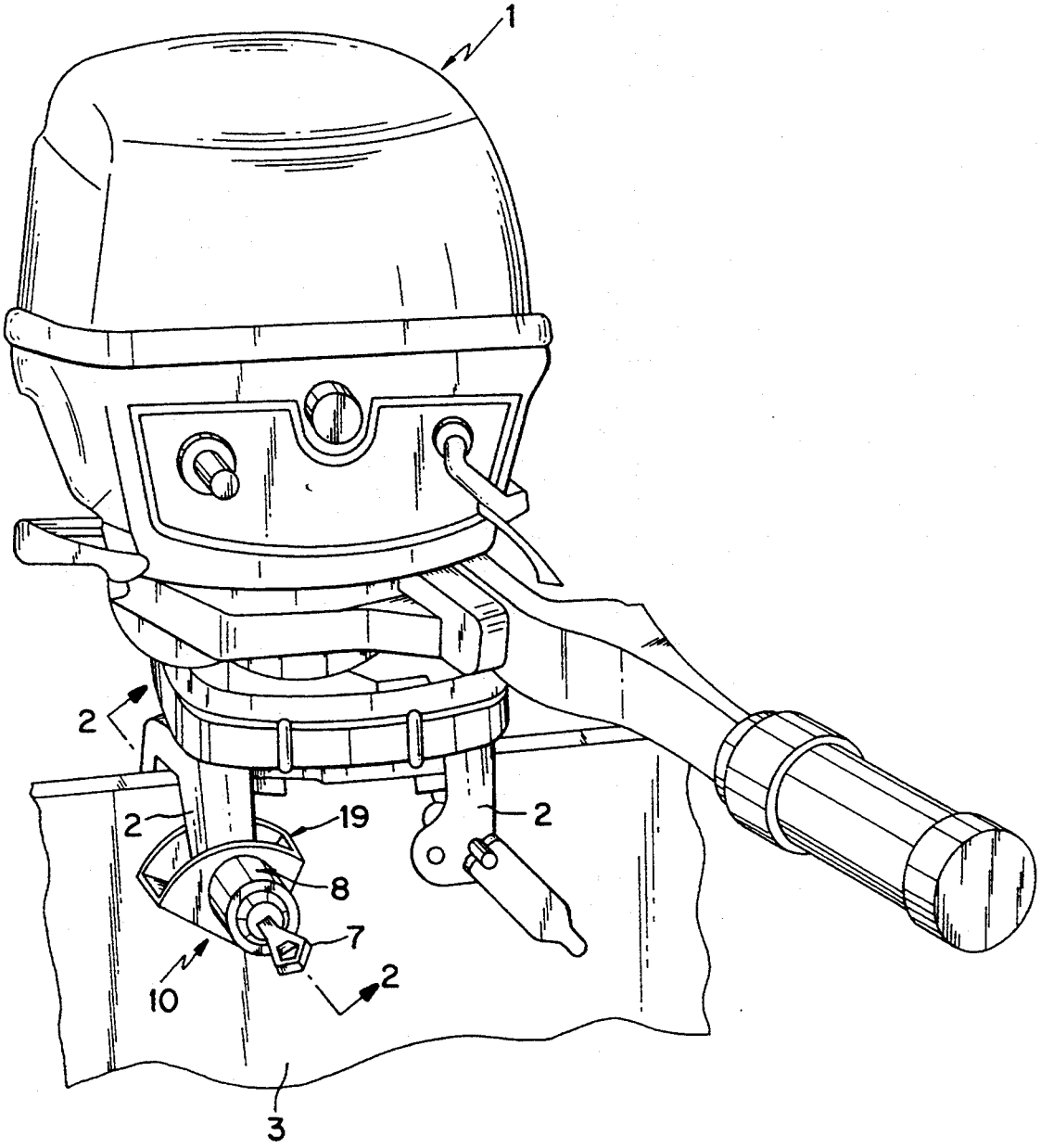
FIG. 1 is a perspective view of an outboard motor which is mounted in the stern of a boat and which has one of its clamping bolts engaged by the locking device according to the invention.

In FIG. 1, an outboard motor 1 is mounted by means of its stern brackets 2 in a motor mount 3 which in the embodiment shown is the stern of a boat. By means of their threaded portion 5, clamping bolts 4 engage the associated threaded holes 6 in the respective bracket 2. The locking device 10 according to the invention receives one of the two clamping bolts (the left one in FIG. 1), which in most cases will be sufficient to prevent theft of the boat motor. In FIG. 1, the locking device 10 is illustrated with its key 7 inserted, but of course this is inserted merely when the lock is to be operated.

Figure 2:
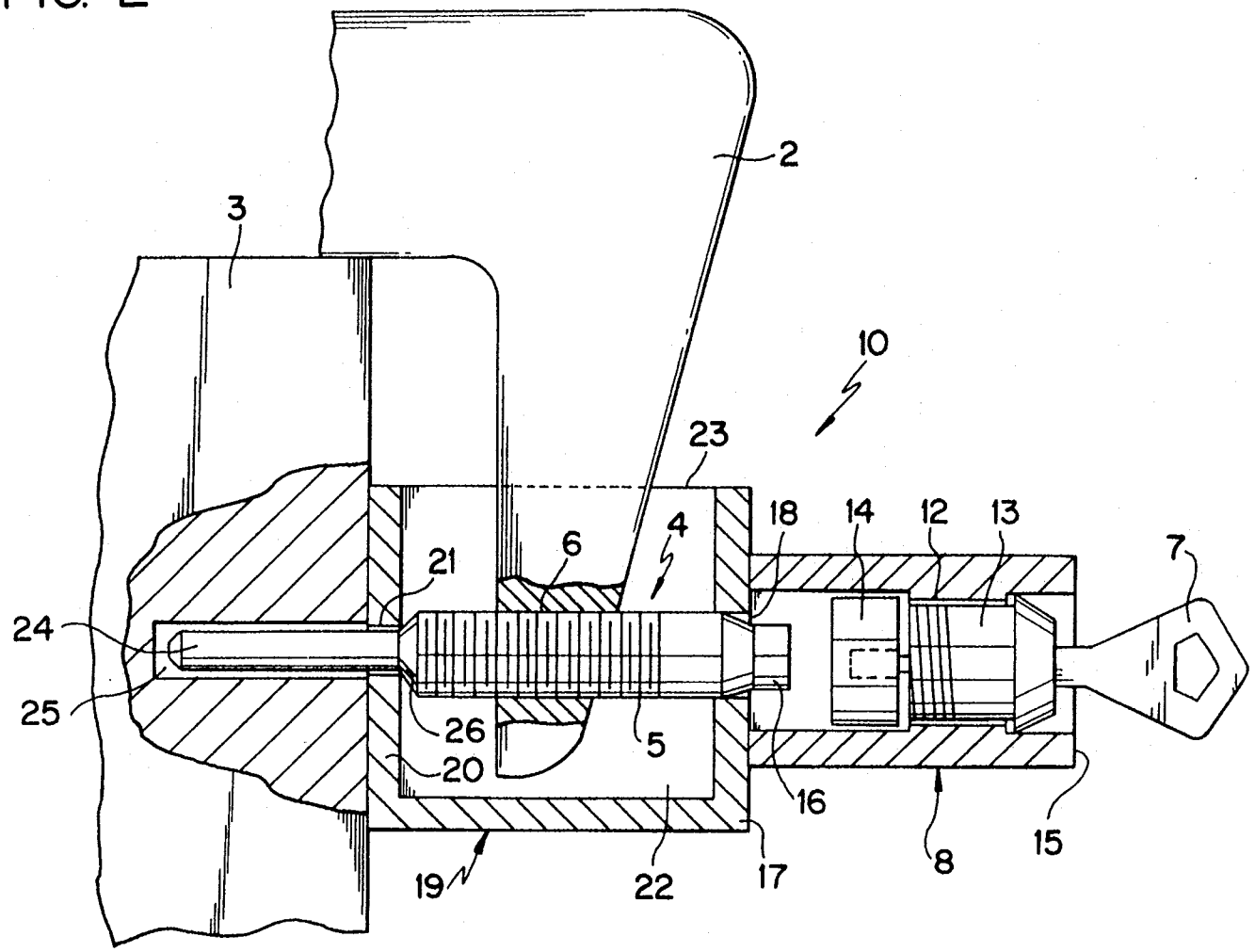
FIG. 2 is an enlarged, partly sectional view, essentially along the line 2—2 in FIG. 1, of a preferred embodiment of the locking device according to the invention.

Reference is now made to FIG. 2 which illustrates the various components of the locking device 10 in more detail. The locking device according to the invention comprises a lock case 8 entirely made of metal, steel or even aluminium, which at all accessible points is protected either by hard surfacing or by cemented carbide pins 9 driven into prebored holes 11 which are strategically positioned in the lock case 8, see FIG. 3. The lock case is a cylindrical, unitary sleeve having end portions of larger diameter than that of its central portion, thereby forming a seat 12. The seat is substantially oval in cross-section for cooperation with a lock cylinder 13 which is releasably arranged in the lock case 8. The inner end of the lock cylinder 13 is provided with a locking shoulder 14 which can be rotated, by means of the key 7, relative to the rest of the lock cylinder 13 and into locking engagement with the seat 12. The lock cylinder 13 is secured against rotation owing to the noncircular cross-section of the seat 12 which is complementary to the cross-section of the lock cylinder. The design of the locking shoulder 14 prevents the core/centre of the lock cylinder from being forced apart, which may otherwise occur if the clamping bolt is manipulated toward the screwing-off position. The design of the locking shoulder, when subjected to stress as described above, causes it to be pressed against the seat which is lathed in the lock case, and thus there will be no stress on the lock cylinder. (The lock cylinder is hardened against drilling attacks.)

Furthermore, the lock cylinder 13 is inserted in the lock case 8 so that its outermost portion is positioned at a given distance inside the edge surface 15 of the lock case, thereby preventing the lock cylinder from being prized loose. The extended "collar" around the lock cylinder prevents the lock cylinder from being broken away. As shown in FIG. 2, the head 16 of the clamping bolt 4 is fully enclosed by the lock case and the lock cylinder in the mounted state of the motor and is thus protected against manipulation from outside, which is further promoted by an end wall 17 which is formed with a hole 18 and to which the lock case 8 is attached, for example by means of welding. The end wall 17 in turn constitutes an end wall of a bolt casing 19 which is thus fixedly connected to the lock case. Opposite to the end wall 17, the bolt casing further comprises an end wall 20 which is also formed with a hole 21. The end walls 17 and 20 are interconnected by means of a substantially V-shaped wall 22 which extends along the clamping bolt 4 and encloses this from two sides, the outer edges 23 of the wall protecting, in cooperation with the associated bracket 2, the bolt against access from the third side (the upper side).

Thus, the head 16 of the clamping bolt 4 extends into the lock case 8 via the hole 18 and its intermediate portion 5 threadingly engages the threaded hole 6 in the stern bracket 2. The other end of the clamping bolt is provided with a terminal extension pin 24 which extends through the hole 21 and into a recess, hole or the like 25 in the stern 3 to secure the motor 1 thereto. The extension pin of the clamping bolt prevents the boat motor from being removed by wiggling. The diameter of the extension pin 24 is smaller than that of the threaded portion 5, whereby an abutment portion 26 is formed therebetween. When tightening the clamping bolt 4 by means of a tool (not shown) which turns the head 16, the extension pin 24 will thus be inserted in the recess 25, and the abutment portion 26 will be pressed against the edge surface of the hole 21. During continued turning of the bolt 4, the end wall 20 is pressed into retaining engagement with the surface of the stern 3 facing the end wall, whereby the boat motor is firmly attached to the stern. When the clamping bolt 4 has been sufficiently tightened, the lock cylinder 13 is locked in the lock case 8, and the bolt is enclosed in and protected by the locking device 10 according to the invention. It is not possible to apply a saw blade or the like to the bolt.

Figure 3:
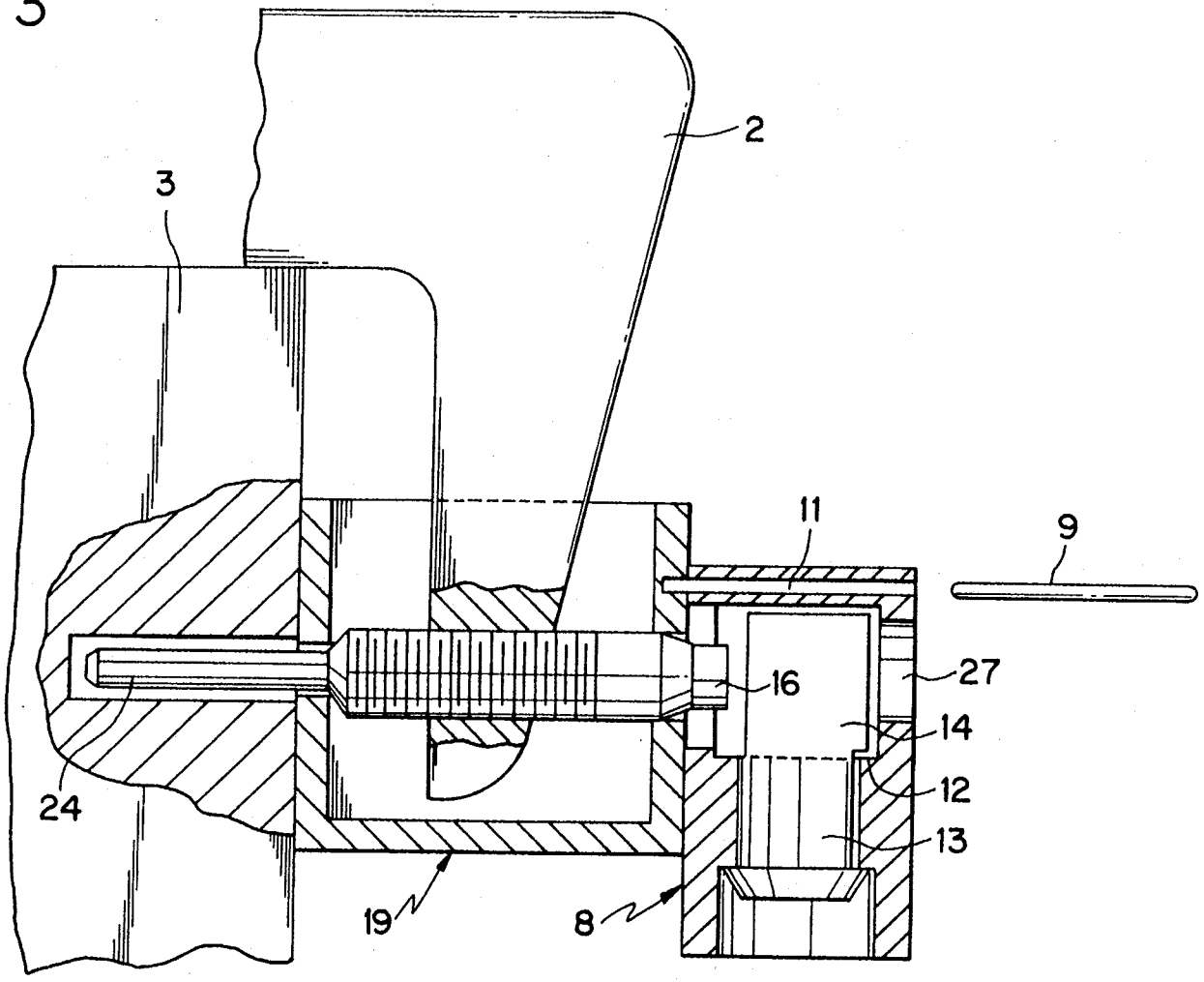
FIG. 3 is a view corresponding to FIG. 2 and illustrates an alternative embodiment of the locking device according to the invention.
Figure 5:
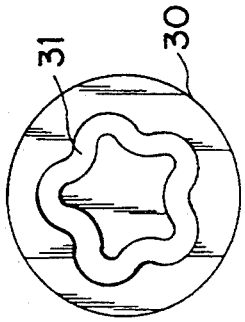
FIG. 5 is an outer end view of the locking bolt shown in FIG. 4, in enlarged scale, and illustrates the key slot of said bolt.

FIG. 3 illustrates an alternative embodiment of the locking device according to the invention, which is principally distinguished from the embodiment described above merely in that the lock case 8 is not concentrically arranged relative to the bolt 4 but extends at right angles thereto. In this alternative embodiment, the cylinder and the locking shoulder can be "let into" the lock case from underneath. As a result, the cylinder is made still more difficult to attack, and moreover all stress that may occur when the clamping bolt is being tampered with is directed to the locking shoulder in lateral direction only. However, the lock case is formed with an access opening 27 in the axial direction of the bolt to allow turning of the bolt by means of an external tool (not shown). After tightening the bolt, the lock cylinder 13, in this embodiment, is also locked in position and internally covers the access opening 27 such that the head 16 of the bolt is again fully enclosed by the lock case and the lock cylinder and cannot be tampered with from outside. Preferably, to protect the lock cylinder against penetrating moisture etc., a cap of plastic or like material may, after mounting of the motor, be caused to seal the free opening of the lock cylinder in both embodiments: described above.

Figure 4:
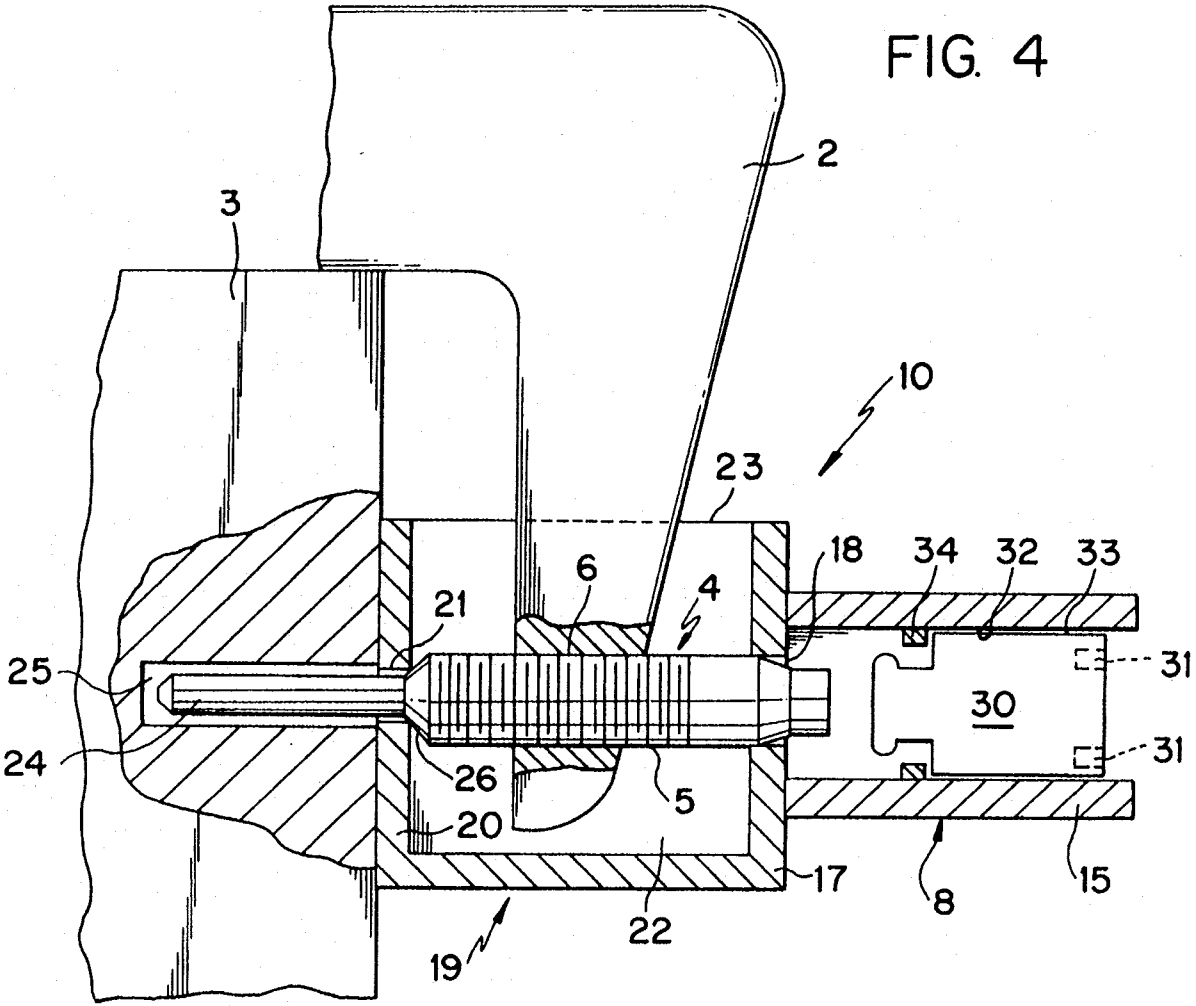
FIG. 4 is a view corresponding to FIG. 2 and illustrates still an alternative embodiment of the locking device according to the invention.

FIG. 4 illustrates still an alternative embodiment of the locking device according to the invention, which is principally distinguished from the embodiment shown in FIG. 2 in that the lock cylinder is substituted by a lock bolt 30 of the "wheel lock and lug nuts" type having a unique slot or recesses 31 on its outer end face. Such wheel nut locks are marketed by McGard Inc., N.Y., for example. The lock bolt 30 is preferred in corrosive environments, where a lock cylinder is apt to get stuck due to corrosion of its parts. In this embodiment of the invention the lock case or house 8 is provided with an internal thread 32 cooperating with an external thread 33 on the cylinder face of the lock bolt 30. With aid of a tool key (not illustrated), having an individually shaped projection or projections mating with said individually shaped slot(-s) 31 on the outer end of the lock bolt, as a key and relating lock, the lock bolt 30 may be screwed into and out of, resp., the lock case 8. In order to restrain the over-insertion of the lock bolt at a preset level in the lock case a stop ring 34 is optionally secured in the lock case, as illustrated in FIG. 4.

While various embodiments have been chosen to illustrate the invention, it will be understood by those skilled in the art that various changes and modifications can be made therein without departing from the scope of the invention as defined in the appended claims.

The invention is not limited to that described above and illustrated in the drawing, but may be modified within the scope of the claims.

We claim:

1. A locking device for an outboard motor, comprising:

a bolt casing having opposed openings therein and means for engaging an outboard motor mount;

a clamping bolt having a thread means for engaging an outboard motor stern bracket, a bolt head at one end thereof and an integral cylindrical extension pin means extending from an opposite end thereof for engaging the outboard motor mount, said clamping bolt extending through said openings in said bolt casing, said thread means being enclosed in said bolt casing, said bolt head and said extension pin means extending from opposite ends of said bolt casing;

an abutment portion on said clamping bolt, between said extension pin means and said thread means, for engaging a respective one of said openings in said bolt casing and for pressing said bolt casing against the motor mount;

a tubular lock case fixedly attached to said bolt casing and enclosing said bolt head, said lock case having an internal cooperating part and a lock case opening; and a lock means, removably mounted in said lock case through said lock case opening and releasably engagable with said cooperating part, for controlling access to said bolt head through said lock case, an end of said lock means remote from said bolt head being positioned inwardly of said lock case opening.

2. A locking device according to claim 1 wherein said extension pin means of said clamping bolt is received in a cooperating recess in the motor mount.

3. A locking device according to claim 1 wherein said lock case and said bolt casing are formed of metal.

4. A locking device according to claim 3 wherein said metal is steel.

5. A locking device according to claim 4 wherein pins of cemented carbide are fixed in prebored holes in said lock case and said bolt casing.

6. A locking device according to claim 3 wherein pins of cemented carbide are fixed in prebored holes in said lock case and said bolt casing.

7. A locking outboard motor mounting, comprising:

a motor mount;

a bolt casing having opposed openings therein and engaging said motor mount;

a clamping bolt having a thread means for engaging an outboard motor stern bracket, a bolt head at one end thereof and an integral cylindrical extension pin means extending from an opposite end thereof for engaging said outboard motor mount, said clamping bolt extending through said openings in said bolt casing, said thread means being enclosed in said bolt casing, said bolt head and said extension pin means extending from opposite ends of said bolt casing;

an abutment portion on said clamping bolt, between said extension pin means and said thread means, for engaging a respective one of said openings in said bolt casing and for pressing said bolt casing against said motor mount;

a tubular lock case fixedly attached to said bolt casing and enclosing said bolt head, said lock case having an internal cooperating part and a lock case opening; and a lock means, removably mounted in said lock case through said lock case opening and releasably engagable with said cooperating part, for controlling access to said bolt head through said lock case, an end of said lock means remote from said bolt head being positioned inwardly of said lock case opening.

8. A locking outboard motor mounting according to claim 7 wherein said extension pin means of said clamping bolt is received in a cooperating recess in said motor mount.

9. A locking outboard motor mounting according to claim 7 wherein said lock case and said bolt casing are formed of metal.

10. A locking outboard motor mounting according to claim 9 wherein said metal is steel.

11. A locking outboard motor mounting according to claim 10 wherein pins of cemented carbide are fixed in prebored holes in said lock case and said bolt casing.

12. A locking outboard motor mounting according to claim 9 wherein pins of cemented carbide are fixed in prebored holes in said lock case and said bolt casing.

13. A locking outboard motor mounting according to claim 7 wherein an outboard motor is coupled to said motor mount and comprises a stern bracket.

* * * * *